US006854538B2

(12) United States Patent
Muuttonen

(10) Patent No.: US 6,854,538 B2
(45) Date of Patent: Feb. 15, 2005

(54) ROCK DRILL

(75) Inventor: Timo Muuttonen, Siuro (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/731,008

(22) Filed: Dec. 10, 2003

(65) Prior Publication Data

US 2004/0112649 A1 Jun. 17, 2004

Related U.S. Application Data

(63) Continuation of application No. PCT/FI02/00506, filed on Jun. 11, 2002.

(30) Foreign Application Priority Data

Jun. 12, 2001 (FI) ..... 20011235

(51) Int. Cl.[7] ..... E21B 4/06

(52) U.S. Cl. ..... 175/414; 175/322; 173/18; 173/58

(58) Field of Search ..... 175/322, 325.2, 175/414, 415, 385, 390; 173/14, 18, 19, 41, 42, 45, 58, 95, 112

(56) References Cited

U.S. PATENT DOCUMENTS 4,109,734 A 8/1978 Montabert
4,658,913 A * 4/1987 Yantsen et al. ..... 173/208
4,718,500 A 1/1988 Mori
4,928,775 A * 5/1990 Lee ..... 175/19
5,002,136 A 3/1991 Barthomeuf
5,435,401 A * 7/1995 Hedlund et al. ..... 175/296
5,680,904 A * 10/1997 Patterson ..... 173/13
5,803,187 A * 9/1998 Javins ..... 175/57
6,502,650 B1 * 1/2003 Beccu ..... 175/296

FOREIGN PATENT DOCUMENTS

WO 9842481 A1 10/1998

* cited by examiner

*Primary Examiner*—Frank Tsay
(74) *Attorney, Agent, or Firm*—Burns, Doane, Swecker & Mathis, L.L.P.

(57) ABSTRACT

A rock drill includes a shank. A percussion piston is arranged to hit the back end of the shank. Further, a pulling element is arranged around the shank, to which a pulling force can be directed in such a manner that the shank can, by the pulling force, be moved toward the percussion piston, when stuck drilling equipment is freed. During rock drilling, a push force is arranged to act on the pulling element, the push force being opposite with respect to the pulling force. The push force is designed in such a manner that during drilling the pulling element moves due to the push force toward the front section of the drill to be at a predefined distance from the position corresponding to the impact point of the shank.

10 Claims, 5 Drawing Sheets

ROCK DRILL

This application is a continuation of international PCT application Ser. No. PCT/FI02/00506, filed Jun. 11, 2002, which was published in English as WO 02/101192 A1 on Dec. 19, 2002, and which is incorporated by reference.

FIELD OF THE INVENTION

The invention relates to a rock drill that comprises: a shank that is arranged in the front section of the drill and that is axially movable; a percussion device having a reciprocating percussion piston on the same axis with the shank and arranged to hit the back end of the shank to provide impact pulses in drilling equipment to be fastened to the shank, the percussion piston having an absorber to absorb the percussion piston impacts that extend to the front side of a designed impact point; and a pulling element that is a sleeve-like piece arranged around the shank, the drill having means for exerting a pulling force to the pulling element and for moving the pulling element by a pulling force axially toward the percussion piston, the pulling element further having a first bearing surface that is arranged to act on a second bearing surface on the shank to move the shank by said pulling force to the designed impact point.

BACKGROUND OF THE INVENTION

In rock drilling, drilling equipment is occasionally caught in the drill hole. If the drilling equipment cannot be pulled out of the drilled hole, the shank and some drill rods need to be left in the drill hole. The drill hole cannot be used after this, and a new hole needs to be drilled beside it. Naturally, such situations are to be avoided, since the loss of drilling equipment and the drilling of a new hole cause considerable extra costs. A feed apparatus of the rock drill is usually used to pull out drilling equipment stuck in a drill hole while at the same time having the percussion device hit the drilling equipment. The problem is, however, that when the drilling equipment is pulled backward, the shank moves away from the impact point and the percussion device cannot produce hard enough impacts to free the stuck drilling equipment from the hole. Solutions have been developed for the above-mentioned problem, in which the shank is pulled to the impact point during the freeing. This is typically arranged by forming a pulling piston to the shank or around it, the pulling piston being arranged through a pressure medium to pull the shank toward the percussion piston in relation to the front end of the rock drill, i.e. toward the designed impact point. Such solutions are disclosed for instance in U.S. Pat. Nos. 4,109,734, 4,718,500, and 5,002,136.

Further, WO publication 98/42481 discloses a solution, in which cylinder spaces parallel to the shank are formed around the shank, each having a pulling piston arranged to it. A pulling sleeve is arranged between the confronting faces of the pulling pistons and the shank to transmit a pulling force from the pistons to the shank.

A problem with known lifting piston constructions is that impacts of the percussion piston also hit the pulling element during normal rock drilling, because at least in upward drilling, the pulling element can due to gravity move against the shank. In present solutions, the operating life of the pulling element is short due to high impact stress. Further, if the pulling element supports the shank during drilling, the impacts of the percussion piston cause a pulling force in the drilling equipment at least when the drilling equipment is not sufficiently supported against rock. As generally known, a pulling force causes the threads between drilling components to open and wears thread joints.

BRIEF DESCRIPTION OF THE INVENTION

It is an object of the present invention to provide a new and improved rock drill, in which impact stress is essentially only directed to the pulling element when stuck drilling equipment is freed by impact.

The rock drill of the invention is characterized in that during rock drilling, a push force is arranged to act on the pulling element, the push force being opposite to the pulling force and stronger than a first backward-acting force exerted to the pulling element during drilling; and that during rock drilling, due to said push force, the pulling element is positioned toward the front section of the drill at a predefined distance from the position corresponding to the impact point of the shank.

The essential idea of the invention is that during rock drilling, a push force is arranged to act on the pulling element for moving the pulling element away from the percussion piston. The push force is made stronger than a first force moving the pulling element toward the percussion piston, whereby the pulling element is, during rock drilling, positioned a predefined distance toward the front section of the drill. In situations, where the drilling equipment is not sufficiently supported against rock due to under-feeding, for instance, the percussion piston cannot hit the pulling element with full force through the shank and the impact is received in a controlled manner by absorbers arranged to the percussion piston. Thus, the impact of the percussion piston does not cause a significant load to the structure of the pulling element during normal drilling and consequently, the operating life of the pulling element and its components can be clearly longer than before. When the percussion device is used to free stuck drilling equipment, the pulling force acting on the pulling element is arranged to be stronger than the push force and the pulling force provided by the feed apparatus, as a result of which the pulling element moves axially toward the percussion piston. The first bearing surface on the pulling element settles against the second bearing surface on the shank, and the pulling element moves the shank to the designed impact point. It is then possible to hit the shank strongly enough with the percussion device while the drilling equipment is pulled out of the hole by means of the feed apparatus. In the solution of the invention, the pulling element is thus activated to pull the shank only when stuck drilling components are freed. Further, because the pulling element does not support the shank against the impact point during drilling, the absorber of the percussion piston absorbs the impacts in situations, where the drilling equipment is due to under-feed or a cavity in the rock insufficiently supported against the rock. In this situation, the absorbed impacts do not cause harmful tensile stress to the drilling equipment. Owing to the invention, no extra stress is directed to the thread joints between the drilling components.

The essential idea of an embodiment of the invention is that the pulling element is a sleeve-like piston arranged coaxially with the shank and having at its front end a pressure surface, on which the pressure of a pressure medium is arranged to act in order to provide a pulling force, and having at its back end a pressure surface, on which the pressure of a pressure medium is arranged to act to provide a push force.

The essential idea of an embodiment of the invention is that the pulling element is a sleeve-like piston arranged coaxially with the shank and that at least one other pulling piston operated by the pressure of a pressure medium and having a shorter axial travel length toward the percussion piston than the travel length of the pulling element is arranged to act on the pulling element. During rock drilling, the pressure of a pressure medium is arranged to act on the pressure surface at the front end of said other pulling piston to keep the other pulling piston in its back position so that it is not in contact with the frame of the drill in the direction of the impact. The pulling element is thus during drilling supported by the other pulling piston. If some of the impact force of the percussion piston is directed to the pulling element through the shank, the absorber arranged to at least one of the pulling pistons receives the impacts in a controlled manner, and the impacts of the percussion piston are never transmitted through a direct mechanical contact to the frame of the drill to cause damage to the drill.

The essential idea of an embodiment of the invention is that on the front side of the pulling element, around the shank, there are several substantially symmetrically arranged cylinder spaces parallel to the shank, each of which is equipped with a cylindrical pulling piston. The pressure of a pressure medium can be directed to act on the front ends of the pulling pistons to provide the pulling force required to lift the shank. The back ends of the pulling pistons are either in direct contact with the pulling element or alternatively, between the pulling pistons and the pulling element, there are pulling pins parallel to the pulling pistons to transmit the tractive force to the pulling element. It is easy to make relatively small cylindrical pulling pistons. In addition, pressure medium leaks are small in this solution.

The essential idea of an embodiment of the invention is that cylindrical pulling pistons arranged in cylinder spaces around the shank are grouped into at least two different piston groups having different travel lengths toward the percussion piston. The pulling pistons having a shorter travel length then support the pulling element backward during rock drilling and the pulling pistons having a longer travel length are used to pull the shank to the impact point when stuck drilling equipment is freed by impact.

The essential idea of an embodiment of the invention is that the pressure of a pressure medium is arranged to act on the back surface of the pulling element to provide a push force.

The essential idea of an embodiment of the invention is that a mixture of gas, such as compressed air, and lubricant used to lubricate the rock drill is arranged to act on the back surface of the pulling element to provide a push force.

For the sake of clarity, it should be noted that a reference to the drill or the front section or front end of a part belonging to it always means the shank-side end, and correspondingly, a reference to the back section or back end means the percussion piston-side end.

BRIEF DESCRIPTION OF THE FIGURES

The invention is described in greater detail in the attached drawings, in which.

In the figures, the invention is shown in a simplified manner for the sake of clarity. The same reference numbers are used of similar parts.

DETAILED DESCRIPTION OF THE INVENTION

Figure 1:
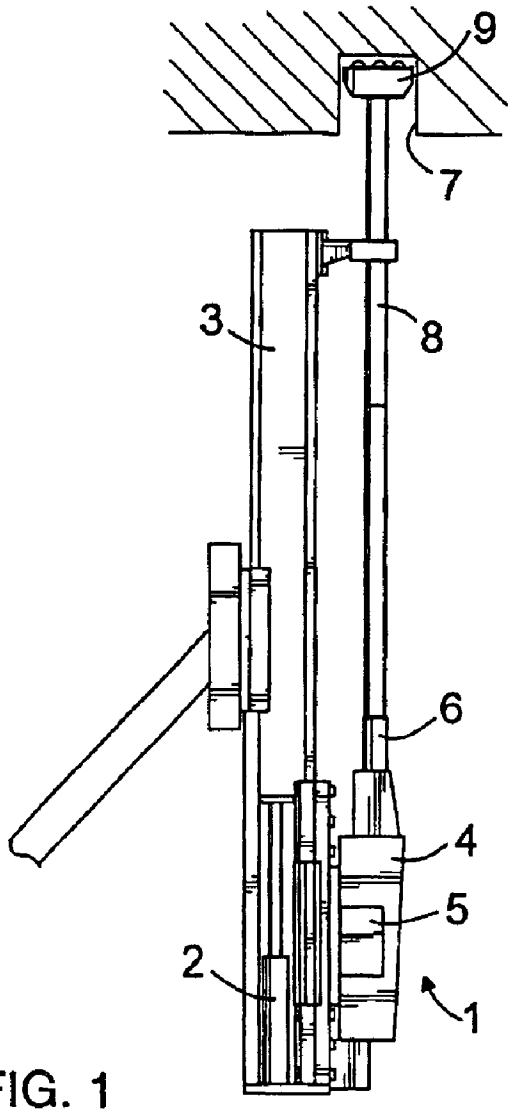
FIG. 1 is a schematic side view of a rock drill of the invention in a situation, where the rock drill drills upward.

FIG. 1 shows a rock drill 1 that can be moved by means of a feed apparatus 2 known per se, such as a hydraulic cylinder, in relation to a feed beam 3. The rock drill comprises a percussion device 4, a rotating device 5 and a shank 6 at the front end of the drill. It is possible to connect a number of drill rods 8 to the front end of the shank 6, the number depending on the depth of the drilled hole 7. A drill bit 9 is arranged to the outermost drill rod 8*a*. During rock drilling, the drill is fed by means of the feed apparatus 2 in such a manner that the drill bit 9 is in contact with the rock being drilled. Further, the percussion device 4 provides impact pulses to the back end of the shank 6, whereby the impact pulses advance in the drill rods as a compression stress wave to the drill bit that due to the impact pulses breaks the rock. At the same time, the shank 6 is rotated by means of the rotating device 5.

Figure 2:
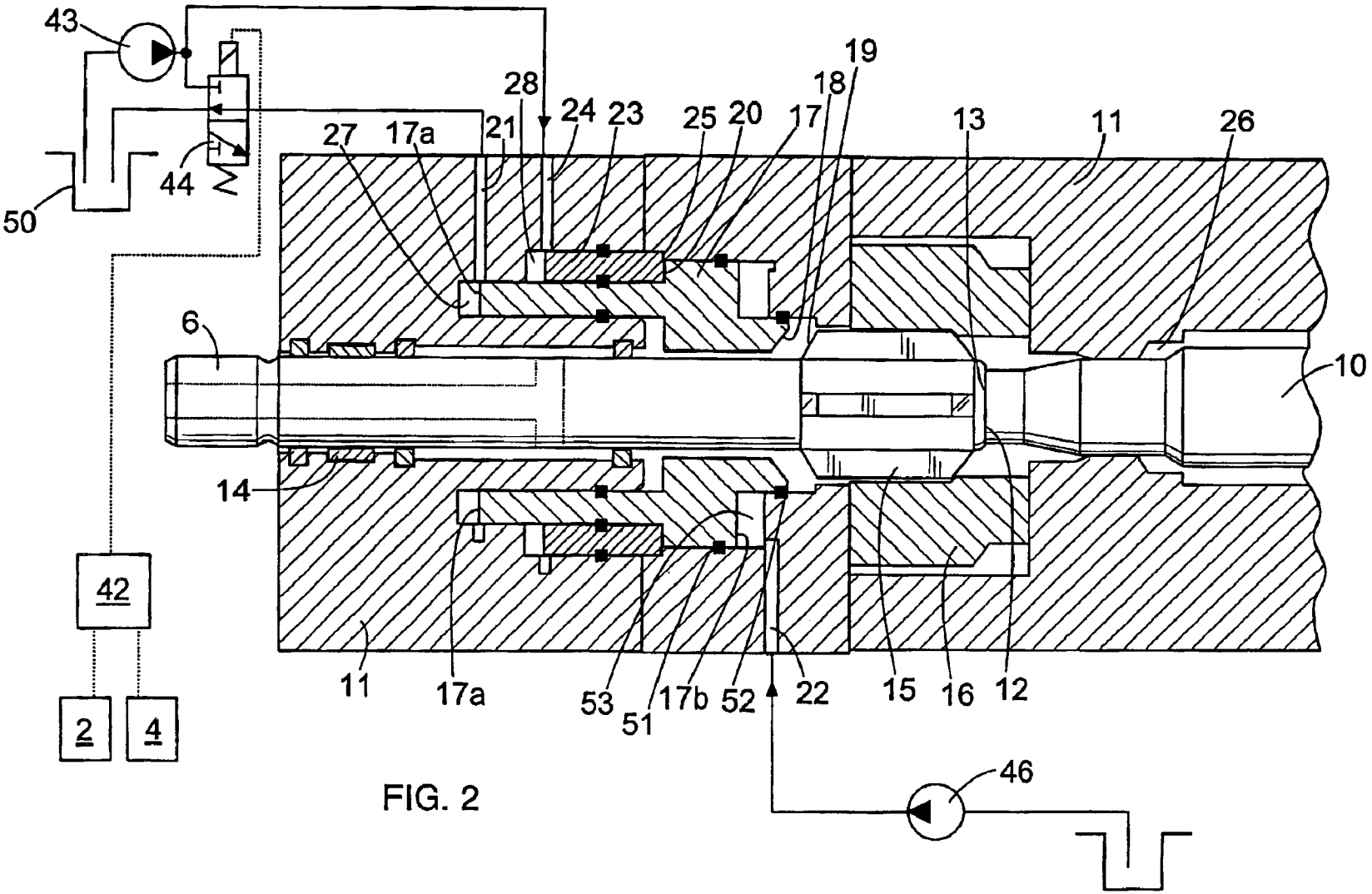
FIGS. 2 and 3 are schematic sectional side views of a section of a rock drill of the invention.

FIG. 2 is a sectional view of the front end of a drill according to a preferred embodiment of the invention. The drill 1 comprises a percussion piston 10 that is moved back and forth in relation to the drill frame 11 by means of the percussion device 4. The shank 6 is in front of the percussion piston 10, and the back end of the shank has an impact surface 12 that the front end 13 of the percussion piston hits. The front end of the drill has a shank bearing 14, which supports the shank so that it can move axially and further, rotated by the rotating device 5, rotate around its axis. The back end of the shank 6 has gearing 15, to which the rotating device 5 is connected to act through a rotating sleeve 16, for instance. The shank 6 can move axially in relation to the rotating sleeve 16. On the front side of the shank gearing 15, a sleeve-like first pulling piston 17 is arranged, having a first bearing surface 18 at its back end. Correspondingly, a second bearing surface 19 is formed on the transverse surface of the front end of the shank gearing 15. A pressure surface 17*a* at the front end of the pulling piston 17 is connected to a first channel 21, through which the pressure of a pressure medium can be led to move the pulling piston 17 axially backward in relation to the frame 11 of the drill. Further, a pressure surface 17*b* at the back end of the pulling piston 17 is connected to a second channel 22, through which the pressure of a pressure medium can be led to move the pulling piston 17 axially forward in relation to the frame 11 of the drill. Around the shank 6, coaxially with the pulling piston 17, yet a second sleeve-like pulling piston 23 is arranged, the pressure surface of its front end being connected to a third channel 24, through which a pressure medium is fed to move the second pulling piston 23 backward. The backward travel length of the second pulling piston 23 is restricted by means of a shoulder 25 or the like to be shorter than the travel length of the first pulling piston 17. The travel length of the first pulling piston 17 toward the percussion piston 10 is designed in such a manner that when the first pulling piston 17 is in its back position, the shank 6 is at an optimum impact point for impact energy transmission, or in a designed manner somewhat in front of the optimum impact point. Further, there is a shoulder 20 on the circumference of the first pulling piston 17, on which the back end of the second pulling piston 23 is arranged to act.

FIG. 2 shows a rock drill in a normal drilling situation, in which pressure of a pressure medium pumped by a pump 43 through the third channel 24 to the pressure surface at the front end of the second pulling piston 23 pushes the second pulling piston 23 against the shoulder 25. The second pulling piston 23 is then not in mechanical contact with the frame 11 in the direction of impact. At the same time, the second pulling piston 23 acts on the shoulder 20 and pushes the first pulling piston 17 toward the percussion piston 10. The first channel 21 is through a valve 44 connected to a tank 50, and a tank pressure acts on the pressure surface 17*a* of the front end of the first pulling piston 17. A propulsive pressure generated by a pump 46 through the second channel 22 acts on the pressure surface 17*b* of the back end of the first pulling piston 17 and makes the first pulling piston 17 press against the back end of the second pulling piston 23. The travel length of the second pulling piston 23 toward the percussion piston 10 is designed such that when the shank 6 is at the impact point during drilling, the bearing surface 18 of the first pulling piston 17 is at a predefined distance from the second bearing surface 19 on the shank 6, as can be seen in the figure. Thus in a situation, in which the drilling equipment is not pressed firmly against the rock and is, therefore, not able to receive the impacts of the percussion piston, the impact force of the percussion piston 10 is absorbed by an absorber 26. Owing to the absorption, the percussion piston 10 cannot during drilling hit the pulling pistons 17 and 23 at full force through the shank 6 and cause an unnecessary impact stress to them. Further, an absorber 27 absorbs the forward movement of the first pulling piston 17 and correspondingly, an absorber 28 absorbs the forward movement of the second pulling piston 23. In some cases, a part of the impact of the percussion piston 10 can despite the absorber 26 hit the pulling pistons 17 and 23. The pulling pistons then move forward due to the impact and the movement is stopped in a controlled manner by the absorbers 27 and 28. The absorbers 27 and 28 ensure that the impacts of the percussion piston 10 never transmit through a mechanical contact to the frame 11 of the drill.

The pulling piston 17 and the frame 11 together limit a circular pressure space 53 that also comprises a pressure surface 17*b* that pushes the pulling piston 17 forward when there is pressure in the pressure space 53. There are preferably sealings 51 and 52 between the pulling piston 17 and the frame 11.

FIG. 2 also shows a control unit 42 of the drill that controls the percussion device 4, the feed apparatus 2 and the valve 44 in order to change the operation of the drill from normal drilling to freeing the drilling equipment by impact, and vice versa.

Figure 3:
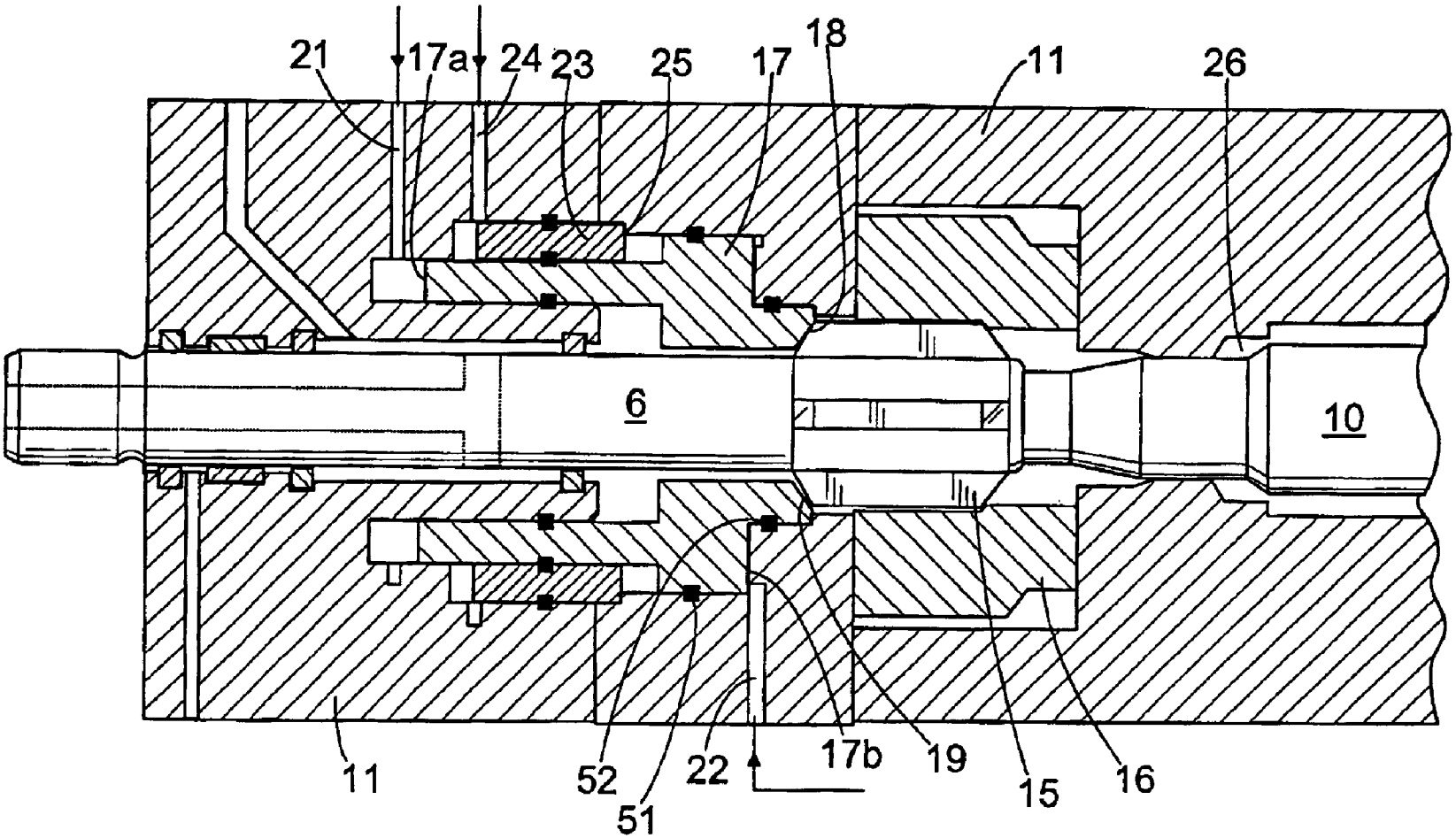

FIG. 3 shows the rock drill of FIG. 2 in a situation, where the feed is reversed with respect to normal drilling and the percussion device uses percussion to free the stuck drilling equipment. The pressure surface of the front end of the second pulling piston 23 is kept against the shoulder 25 by means of the pressure of a pressure medium. Further, the pressure of a pressure medium, causing a stronger pulling force than the backward pulling force caused by the feed apparatus, acts on the pressure surface 17*a* of the front end of the first pulling piston 17. The bearing surface 18 on the first pulling piston 17 then settles firmly against the second bearing surface 19 on the shank 6 and makes the first pulling piston 17 to move the shank 6 toward the percussion piston 10. The backward movement of the first pulling piston 17 is restricted to the point, where the shank 6 is at the impact point, i.e. the desired point, with respect to impact energy transmission. This way, the shank 6 can be moved to the impact point despite the fact that the feed apparatus pulls the drill frame 11 backward in relation to the shank 6. The percussion device is then able to hit the drilling equipment so that together with the pulling force they free the stuck drilling equipment from the drill hole. The pressure of a pressure medium can also be fed from the channel 22 to act on the pressure surface 17*b* of the back end of the first pulling piston 17 during the freeing impact, or alternatively, the channel 22 can be connected to the tank when the drilling equipment is freed by impact.

Figure 4:
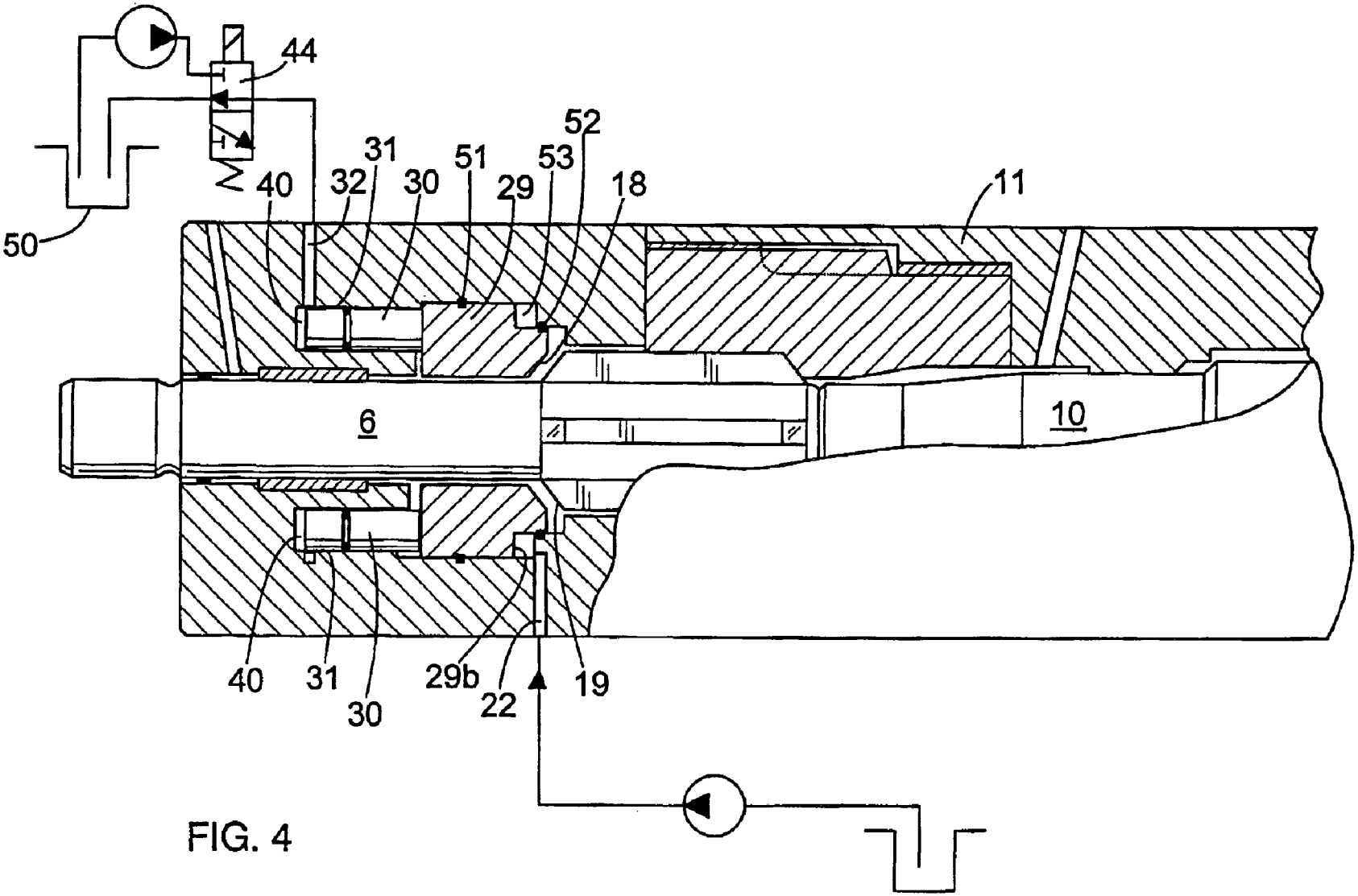
FIG. 4 is a schematic sectional side view of a section of a second rock drill of the invention.
Figure 5:
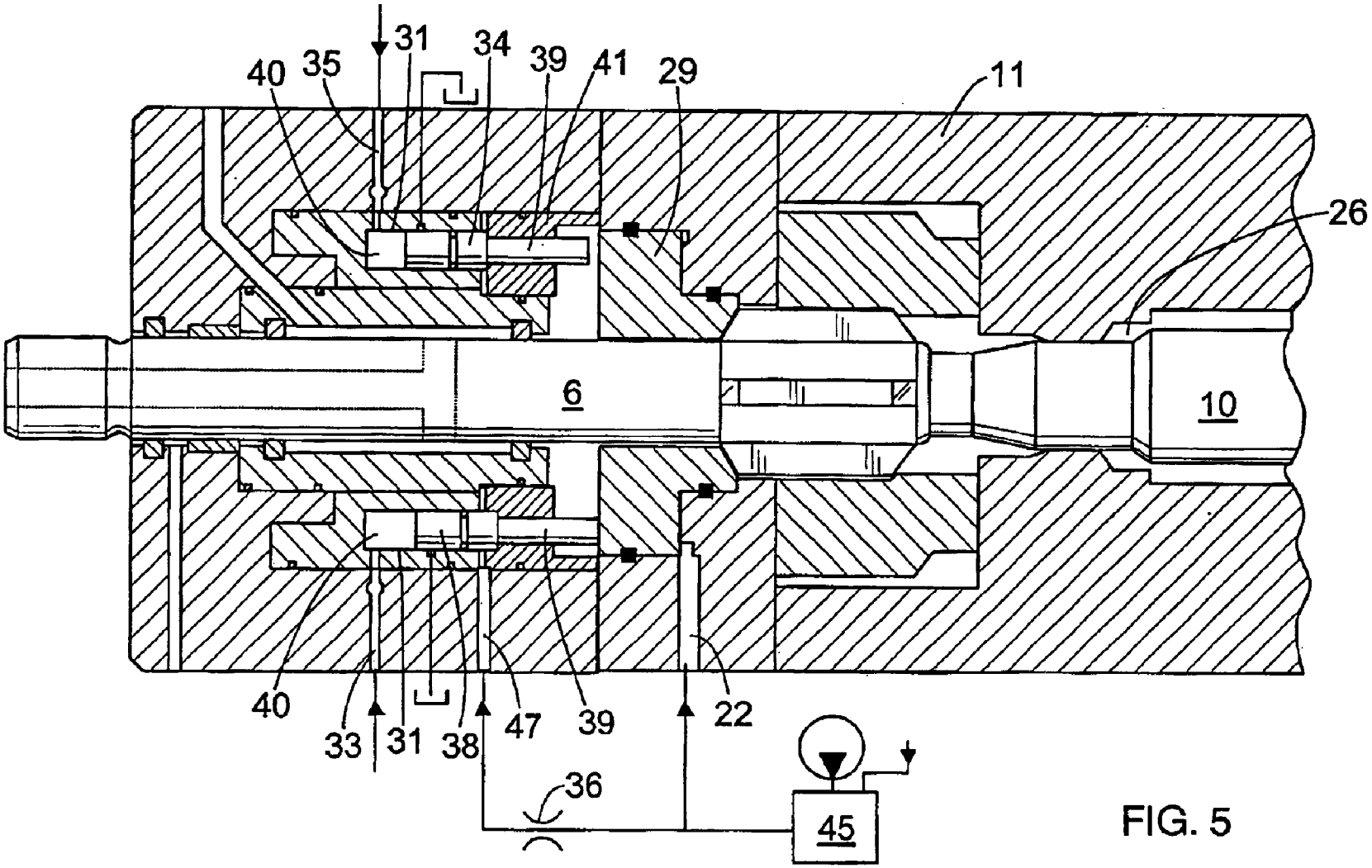
FIG. 5 is a schematic sectional side view of a section of a third rock drill of the invention.

In the construction shown in FIG. 4, a pulling sleeve 29, having the first bearing surface 18 at its back end, is arranged in front of the second bearing surface 19. The pulling sleeve 29 is moved axially toward the percussion piston 10 in the cylinder space around the shank 6 by means of several cylindrical pulling pistons 30 located in front of the pulling sleeve 29. The pulling pistons 30 are arranged in separate cylinder spaces 31 around the shank 6 parallel thereto and preferably located on the circumference of a circle coaxial with the shank 6. The cylinder spaces 31 are formed directly to the frame 11 of the drill or alternatively to a separate frame piece as shown in FIG. 5. The pressure surfaces of the front end of the pulling pistons 30 are connected to a common channel 32, from which a pressure medium is fed to move the pulling pistons 30 simultaneously backward in the cylinder spaces 31 to produce the required pulling force. The back ends of the pulling pistons 30 are in contact with the front end of the pulling sleeve 29. In the situation shown in the figure, i.e. during drilling, tank pressure acts on the pressure surface of the front end of the pulling pistons 30, since the channel 32 is through the valve 44 connected to the tank 26. A propulsive pressure is exerted from the channel 22 to the pressure surface 29*b* at the back end of the pulling sleeve 29 to provide the required push force. The push force to the pulling sleeve 29 is designed in such a manner that the pulling sleeve 29 moves due to the push force a distance towards the front end of the drill. Further, at the front ends of the pulling pistons 30, absorbers 40 receive the forward movement of the pulling pistons 30, if a part of the impact force reaches them through the shank 6 and the pulling sleeve 29. At the extreme position of the absorbed movement, the pulling sleeve 29 settles against the frame 11.

In the rock drill shown in FIG. 5, the cylindrical pulling pistons arranged in the cylinder spaces 31 around the shank 6 are divided into two groups. The pulling piston groups have different travel lengths toward the percussion piston 10. The pressure of a pressure medium is led from the common channel 33 to the front-end pressure surfaces of the first pulling pistons 38, having a longer travel length, only when the shank 6 is lifted to the impact point during freeing by impact. A tractive force that is stronger than the pulling force caused by the feed apparatus is then formed by means of the pulling pistons 38 having a longer travel length. The pressure of a pressure medium is exerted from the common channel 35 to the pressure surfaces of the second pulling pistons 34, having a shorter travel length, during normal drilling and preferably also during freeing by impact. In FIG. 5, the drill is shown when the drilling equipment is being freed. During drilling, the pulling sleeve 29 is in turn pushed forward by the pressure medium fed from the channel 22 and acting on the back-end pressure surface of the pulling sleeve 29, and further, it is pulled backward a limited distance by the tractive force caused by the second pulling pistons 34 that is stronger than the push force acting on the pulling sleeve 29. At least the second pulling pistons 34 comprise absorbers 40 that absorb their forward movement in their extreme position. Further, between the pulling sleeve 29 and each pulling piston 38, 34, there is a pulling pin 39 parallel to the pulling piston to transmit the push force generated by the pulling piston to the pulling sleeve 29. The pulling pins 39 are made of a wear-resistant material and arranged exactly at the location of the pulling pistons 38, 34 by means of an alignment sleeve 41. The alignment sleeve 41 also serves as a stopping element for the pulling pistons 34.

FIG. 5 also shows a spray apparatus 45, in which pressurized air or some other pressurized gas and a lubricant are mixed into a lubricant mist. Lubricant mist is led along suitable lubrication channels 47 to critical locations of the drill. Lubricant mist can also be used to generate the push force. The channel 22 is then connected to the spray apparatus 45. The pressure line running to the lubrication channel 47 has a pressure reducer 36, such as a throttle or pressure-reducing valve. The pressure in the valve 22 is arranged to be higher than the pressure in the lubrication channel 47.

Normally, it is enough that the size of the push force is designed in such a manner that it is stronger than the gravity caused by the mass of the pulling element in upward drilling and the force directed to the pulling element and caused by the tank pressure exerted to the front ends of the pulling pistons. The tank pressure generally differs from zero pressure, and a tractive force of a certain size is generally formed in the pulling pistons that can move the pulling element backward.

The rock drill can also be such that during drilling the pulling pistons or the like having a longer travel length and extending until the position corresponding to the impact point are arranged to act on the pulling element. The strength of the push force is then designed with respect to the tractive force directed to the pulling element in such a manner that during drilling the pulling element remains at a designed distance from its rearmost extreme position.

The drawings and the related description are only intended to illustrate the idea of the invention. The invention may vary in detail within the scope of the claims. Thus, the percussion apparatus does not necessarily need to be pressure medium-operated, and the impact pulses can also be generated electrically, for instance. Similarly, the rotation of the drilling equipment can also be achieved otherwise than by means of a rotation motor arranged to the drill. Further, it is possible to arrange the push force acting on the pulling element in some other manner than that shown by way of example in the figures of the application. One possibility is to arrange a suitable actuator at the back of the pulling element and to use it to move the pulling element toward the front part of the drill. The push force can also be provided electrically.

What is claimed is:

1. A rock drill comprising:

a frame;

a shank that is arranged in the front section of the drill and that is axially movable;

a percussion device having a reciprocating percussion piston on the same axis with the shank and arranged to hit the back end of the shank to provide impact pulses in drilling equipment to be fastened to the shank, the percussion piston having an absorber to absorb the percussion piston impacts that extend to the front side of a designed impact point;

a pulling element that is a sleeve-like piece arranged around the shank, the drill having means for exerting a pulling force to the pulling element and for moving the pulling element by a pulling force axially toward the percussion piston, the pulling element further having a first bearing surface that is arranged to act on a second bearing surface on the shank to move the shank by said pulling force to the designed impact point, and wherein:

during rock drilling, a push force is arranged to act on the pulling element, the push force being stronger than the pulling force exerted to the pulling element during drilling; and during rock drilling, due to said push force, the pulling element is positioned toward the front section of the drill at a predefined distance from the position corresponding to the impact point of the shank.

2. A rock drill as claimed in claim 1, wherein at the back end of the pulling element, there is a pressure surface and that the pressure surface is connected to a channel for feeding a pressure medium to act on said pressure surface to achieve the push force.

3. A rock drill as claimed in claim 2, wherein the pulling element and the frame of the drill limit between them a circular pressure space that has a pressure surface.

4. A rock drill as claimed in claim 3, wherein the circular pressure space is sealed with sealings arranged between the pulling element and the frame of the drill.

5. A rock drill as claimed in claim 2, wherein the pressure medium is a mixture of gas and lubricant used to lubricate the drill.

6. A rock drill as claimed in claim 1, wherein at the front end of the pulling element, there is a pressure surface that is connected to a first channel, and the pressure of a pressure medium is fed from said channel to act on said pressure surface to achieve a pulling force.

7. A rock drill as claimed in claim 6, wherein a sleeve-like second pulling piston is arranged coaxially with the pulling element, at the front end of the second pulling piston, there is a pressure surface that is connected to a channel for feeding a pressure medium to said pressure surface in order to move the second pulling piston toward the percussion piston, a pulling force provided by the second pulling piston is stronger than a force having an opposite direction and acting on the pulling element, the circumference of the pulling element has a shoulder, on which the second pulling piston is arranged to act for generating a pulling force in order to move the pulling element toward the percussion piston, the movement of the pulling element is restricted by a mechanical surfaces formed in the frame, the movement of the second pulling piston toward the percussion piston is restricted by the shoulder in such a manner that the pulling element is in the rearmost position of the second pulling piston at a distance from the mechanical surfaces limiting the forward movement of the pulling element, and the forward movement of at least the second pulling piston is absorbed by an absorber.

8. A rock drill as claimed in claim 1, wherein on the front side of the pulling element, there are several cylinder spaces parallel to the shank, each cylinder space is equipped with a cylindrical pulling piston, and the pressure of a pressure medium is led from a channel to the front ends of the pulling pistons to move the pulling pistons toward the percussion piston and to provide a pulling force to the pulling element.

9. A rock drill as claimed in claim 8, wherein the cylindrical pulling pistons are divided according to their travel length into at least two piston groups, and the movement of the pulling pistons having a shorter travel length is limited toward the percussion piston, during rock drilling, the pulling pistons having a shorter travel length are arranged to provide a second force toward the percussion piston that is stronger than the push force acting on the pulling element, the pulling element is during rock drilling supported by means of the pulling pistons having a shorter travel length to be at a distance from the foremost extreme position of the pulling element, and there is an absorber arranged at least to each pulling piston having a shorter travel length for absorbing the forward movement of the pulling piston and the pulling element supported thereby in the foremost extreme position of the pulling pistons.

10. A rock drill as claimed in claim 8, wherein a pulling pin parallel to the pulling piston is arranged between each pulling piston and the pulling element behind it to transmit a force from the pulling piston to the pulling element.

* * * * *